US010604311B2

(12) United States Patent
Scanish et al.

(10) Patent No.: US 10,604,311 B2
(45) Date of Patent: Mar. 31, 2020

(54) RIGID PACKAGE FOR MOISTURE-SENSITIVE ADHESIVE

(71) Applicant: Carlisle Intangible, LLC, Scottsdale, AZ (US)

(72) Inventors: Michael J. Scanish, Camp Hill, PA (US); Earl Buzzard, Albuquerque, NM (US); Chris Mahon, Huntington Woods, MI (US)

(73) Assignee: Carlisle Intangible, LLC, Scottsdale, AZ (US)

( * ) Notice: Subject to any disclaimer, the term of this patent is extended or adjusted under 35 U.S.C. 154(b) by 0 days.

(21) Appl. No.: 16/011,807

(22) Filed: Jun. 19, 2018

(65) Prior Publication Data

US 2018/0362227 A1 Dec. 20, 2018

Related U.S. Application Data

(60) Provisional application No. 62/521,566, filed on Jun. 19, 2017.

(51) Int. Cl.

| | |
|---|---|
| ***B65D 51/16*** | (2006.01) |
| ***B65D 5/42*** | (2006.01) |
| ***B65D 81/26*** | (2006.01) |
| ***B65D 21/02*** | (2006.01) |
| ***B65D 77/06*** | (2006.01) |
| ***B65D 1/18*** | (2006.01) |
| ***B65D 1/20*** | (2006.01) |
| ***B65D 25/28*** | (2006.01) |
| ***B65D 25/00*** | (2006.01) |
| *B05B 9/00* | (2006.01) |

(Continued)

(52) U.S. Cl.

CPC ..... *B65D 51/1627* (2013.01); *B65D 1/18* (2013.01); *B65D 1/20* (2013.01); *B65D 5/4295* (2013.01); *B65D 21/0202* (2013.01); *B65D 21/023* (2013.01); *B65D 21/0212* (2013.01); *B65D 21/0215* (2013.01); *B65D 21/0231* (2013.01); *B65D 25/00* (2013.01); *B65D 25/2894* (2013.01); *B65D 25/2897* (2013.01); *B65D 77/067* (2013.01); *B65D 81/263* (2013.01); *B05B 9/007* (2013.01); *E04D 15/00* (2013.01); *E04D 15/07* (2013.01)

(58) Field of Classification Search

USPC ..... 222/185.1, 608

See application file for complete search history.

(56) References Cited

U.S. PATENT DOCUMENTS 1,746,332 A * 2/1930 Barroll ..... B65D 21/022 206/509
3,387,749 A * 6/1968 Godshalk ..... B65D 21/0231 206/501
4,482,067 A * 11/1984 Saito ..... B65D 23/001 206/509

(Continued)

*Primary Examiner* — Vishal Pancholi

(74) *Attorney, Agent, or Firm* — Wood Herron & Evans LLP

(57) ABSTRACT

A container for use in a gravity-fed dispenser, particularly for construction adhesives, includes a top surface with an outlet port, a bottom surface with a venting port and side walls, said side walls including two opposed indentations that provide handle grasps for a user, allowing the user to hold the container in an upside down position while it is attached to a dispenser. The vent on the bottom surface allows the contents to flow evenly through gravity out of the outlet port.

10 Claims, 12 Drawing Sheets

(51) Int. Cl.
*E04D 15/00* (2006.01)
*E04D 15/07* (2006.01)

(56) References Cited

U.S. PATENT DOCUMENTS 5,993,676 A * 11/1999 Lowery, Jr. ..... B01D 17/0208 210/515
6,050,455 A * 4/2000 Soehnlen ..... B65D 1/20 215/382
6,325,212 B2 * 12/2001 Przytulla ..... B65D 1/12 206/509
6,367,665 B1 * 4/2002 Barriac ..... B05B 9/0426 222/383.1
6,401,989 B1 * 6/2002 Grittmann ..... B67D 3/043 222/518
6,591,986 B2 * 7/2003 Soehnlen ..... B65D 1/20 206/434
7,182,214 B2 * 2/2007 Darr ..... B65D 1/0223 215/365
7,802,704 B2 * 9/2010 Hatch ..... B65D 47/305 222/534
8,342,372 B2 * 1/2013 Choiniere ..... B05B 9/007 222/145.5
8,701,929 B1 * 4/2014 Long ..... B65D 25/22 215/276
2003/0132184 A1 * 7/2003 Dorn ..... B65D 1/18 215/10
2007/0175930 A1 * 8/2007 Heisner ..... B65D 1/04 222/538
2013/0168420 A1 * 7/2013 Kern ..... B67D 7/845 222/608
2017/0029168 A1 * 2/2017 Olarte ..... B65D 21/0202

* cited by examiner

RIGID PACKAGE FOR MOISTURE-SENSITIVE ADHESIVE

CROSS-REFERENCE TO RELATED APPLICATION

This application claims the benefit of and priority to prior filed Provisional Application Ser. No. 62/521,566, filed Jun. 19, 2017, which is expressly incorporated herein by reference.

BACKGROUND OF THE INVENTION

In many applications, particularly in the construction industry, adhesives are applied from bulk containers using dispensers. In particular, moisture-sensitive two-part adhesive systems can be applied using such dispensers. These dispensers mix the two components and apply the blended adhesive as desired. These two-part adhesive systems can be polyurethanes which are very moisture sensitive. An adhesive dispenser used for such applications is disclosed in U.S. Pat. No. 8,167,170, the disclosure of which is incorporated herein by reference.

Typically, these bulk containers of adhesives are plastic bags or bladders having an outlet port which attaches to the dispenser. The bags are stored in corrugated boxes. These containers are not optimal for a number of reasons. The flexible films may not provide an adequate moisture vapor barrier, particularly when the adhesive is stored for longer periods of time. Also, the packaging itself can be left outside and subjected to rain, temperature extremes and sunlight, including ultraviolet radiation. This reduces useful life of these containers and in turn, can result in the adhesive becoming unsuitable for use.

SUMMARY OF THE INVENTION

The present invention is premised on the realization that a container suitable for moisture-sensitive adhesives or other moisture-sensitive materials can be formed from a rigid thermoplastic plastic which has excellent moisture barrier characteristics. The container includes a top wall, bottom wall and side walls connecting the top and bottom walls and a dispensing port through the top wall. A venting port, in turn, extends through the bottom wall. Opposed indentations in the side walls allow an individual to hold the container with the top wall facing downward for insertion into a gravity-fed dispensing apparatus. The side walls can further include an indentation which receives an adapter designed to connect the outlet port to the inlet of the gravity feed dispenser. This allows the containers of the present invention to be stacked, one on top of the other. This reduces storage requirements. The vent allows for the constant downward flow of the adhesive into the dispenser and, at the same time, the vent can be resealed to allow the partially-used materials be stored.

The objects and advantages of the present invention will be further appreciated in light of the following detailed descriptions and figures in which:

DETAILED DESCRIPTION OF THE INVENTION

Figure 1:
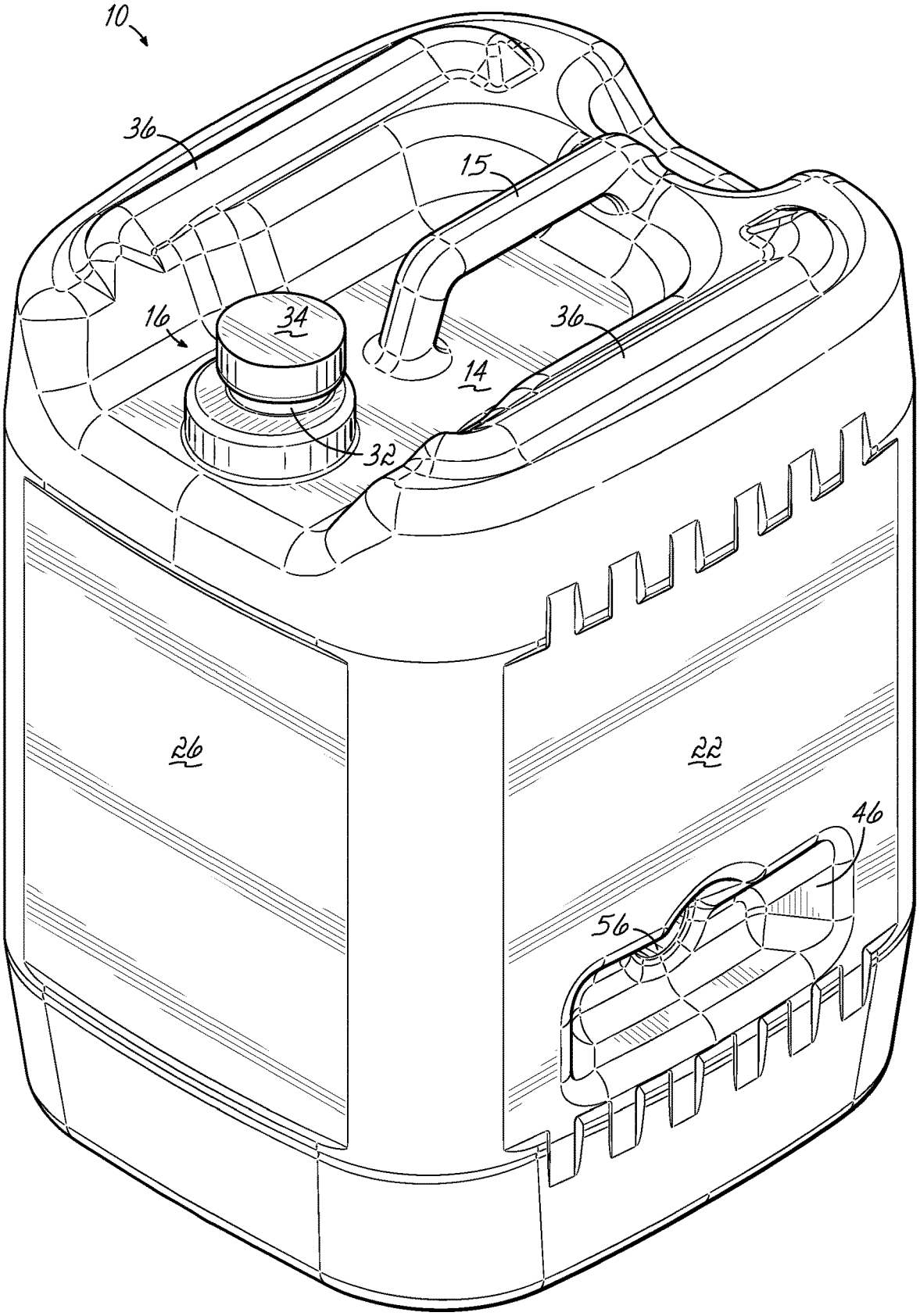
FIG. 1 is a front perspective view of the present invention with the container in the upright position.
Figure 2:
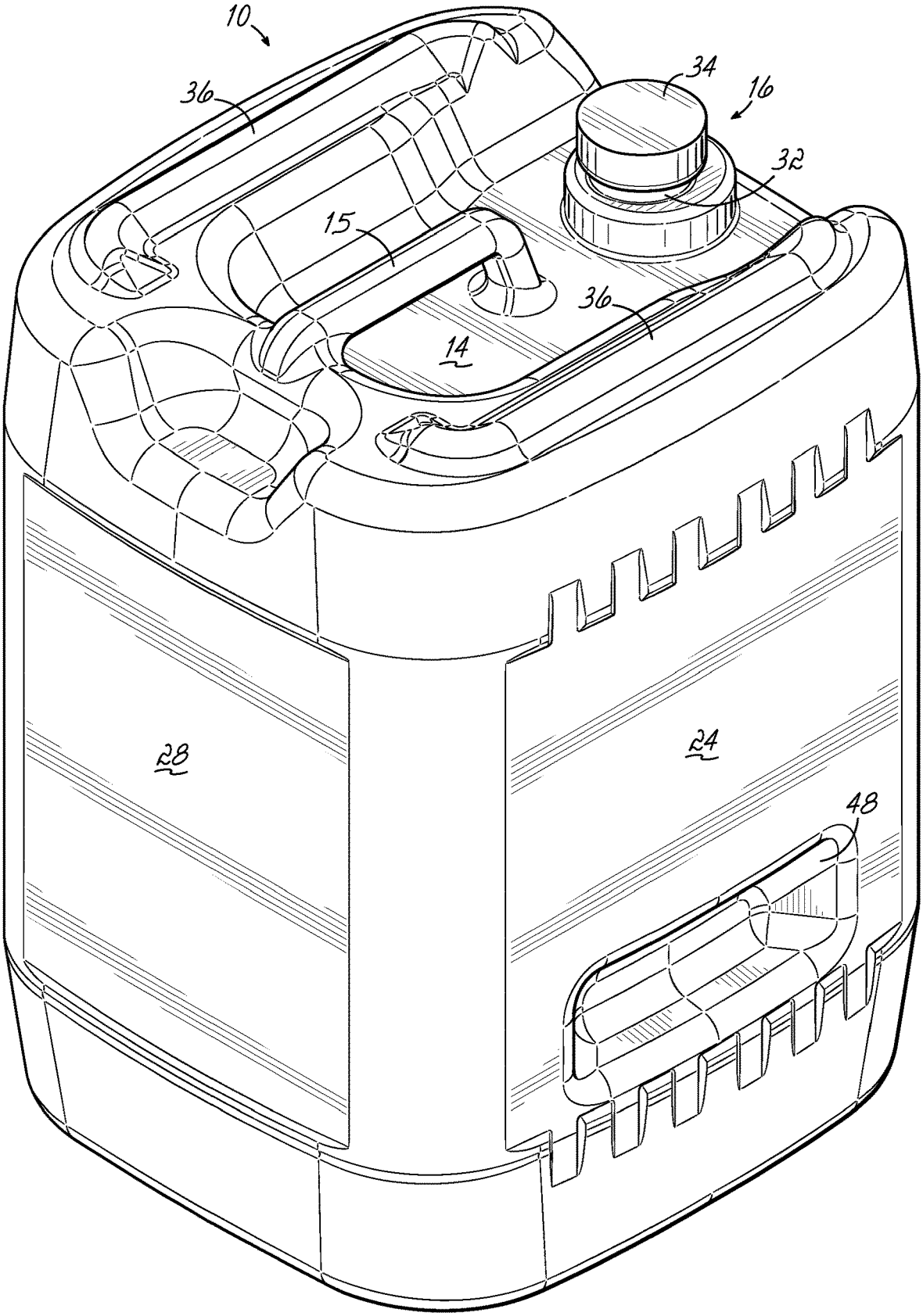
FIG. 2 is a perspective view similar to FIG. 1, showing the rear of the container.

As shown in FIG. 1, the present invention is a rigid plastic container 10 particularly suitable for use in storing moisture-sensitive materials and, in particular, for storing moisture-sensitive materials which can be fed into a gravity dispenser. These may be components (polyols and polyisocyanates) of a polyurethane adhesive such as those used in roofing applications. The container 10 is formed from a rigid plastic material. By rigid, it is simply meant that the present invention is self-supporting and, when compressed, will act to retain its prior form.

The present invention can be formed from a variety of different plastics, preferably a thermoplastic which is suitable for blow molding. The plastic must have a low permeability to moisture. Typically, such materials include high density polyethylene, medium density polyethylene, polypropylene, poly(tetrafluoroethylene) and poly (vinylidene chloride). Although the overall wall thickness will vary, depending upon the plastic used and the design, the wall thickness will generally be from about 0.025" to about 0.090" and more particularly from about 0.050" to about 0.075". The container should have a very low moisture vapor permeation rate, generally 0.015 US perms or less. The container can be formed by well-known methods such as blow molding, injection molding and rotational molding.

Figure 11:
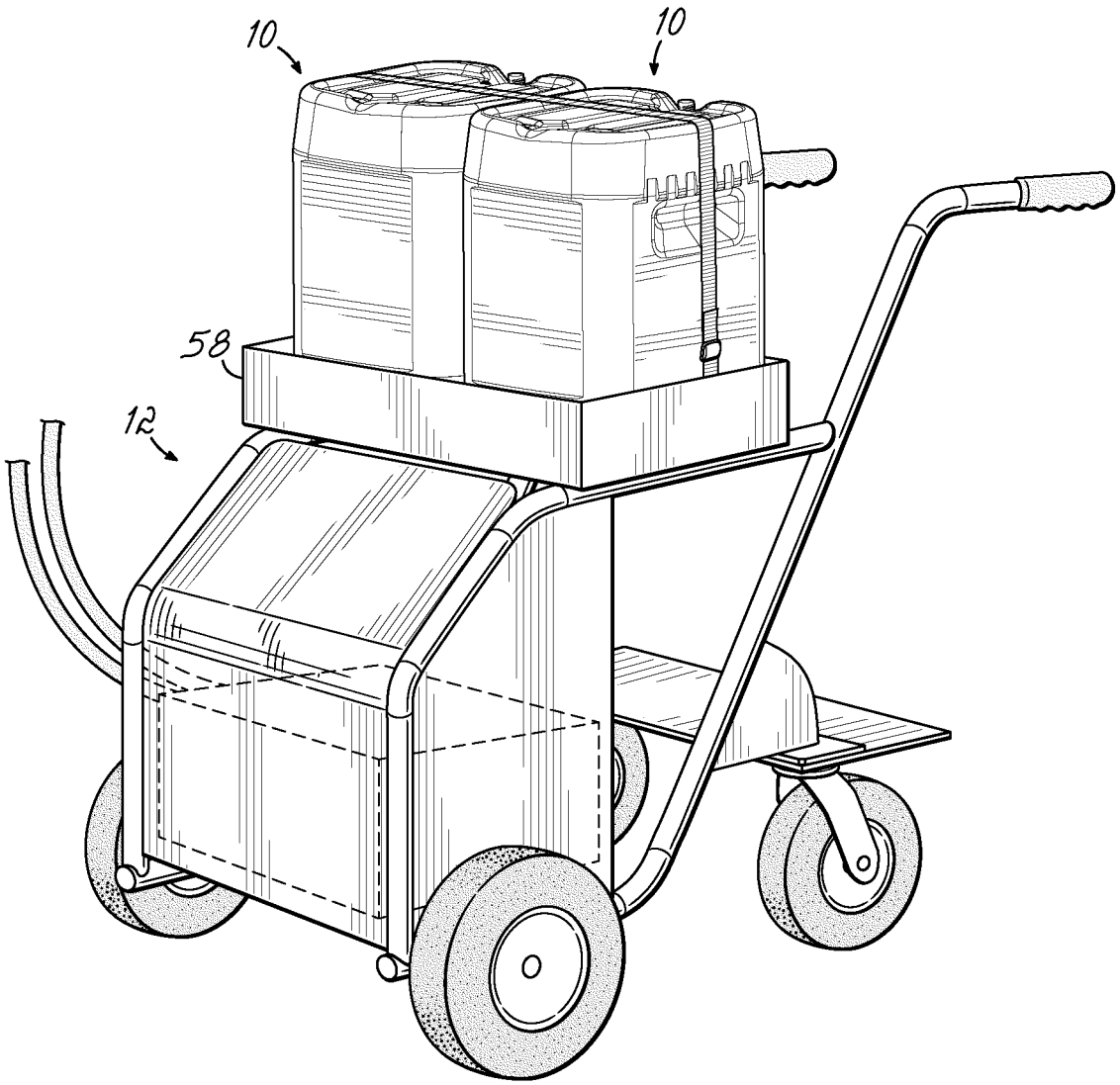
FIG. 11 is a perspective view of the present invention in its environment.

The container 10 is intended to be used with a gravity-fed dispenser, an exemplary one of which is disclosed in U.S. Pat. No. 8,167,170, the disclosure of which is hereby incorporated by reference. Further, an exemplary dispenser 12 is shown in FIG. 11.

The container 10 includes a top surface 14 having an outlet port 16 and a bottom surface 18 with a vent port 20. The terms "top" and "bottom" in this application refer to the container while it is being stored and/or transported. In use, the containers are inverted so the top surface or wall 14 faces downwardly. As shown, the top 14 includes a handle 15 which allows the container 10 to be easily grasped and carried.

The container 10 further includes four side walls 22, 24, 26 and 28 which connect the top surface 14 and the bottom surface 18. The container 10 is shown as a cube, however, it can be other shapes such as a cylinder and the like. But for maximizing storage capacity a cube is optimal. As shown, the top surface 14, in addition to handle 15, includes the outlet port 16 which includes a cap 34 attached to an externally-threaded neck 32. The size of the outlet port 16 is designed based on the contents within the container and should be sufficient to allow the material within the container to easily flow by gravity. Typically, it may have a diameter of about 38 mm. The top surface 14 is designed to nest with the bottom surface 18 so these containers 10 can be stacked on each other. As such, top surface 14 includes an upper peripheral ridge 36.

Figure 3:
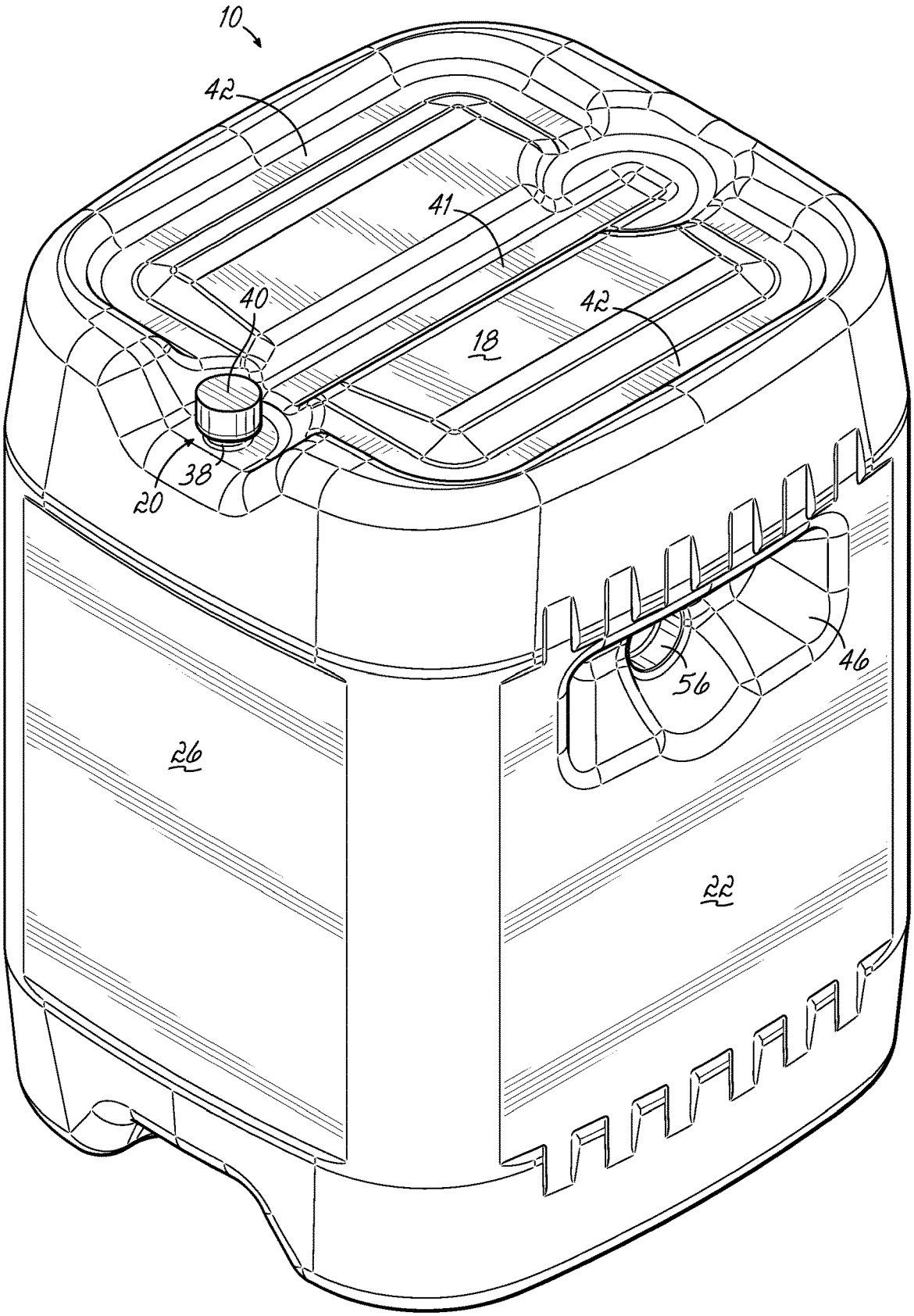
FIG. 3 is a rear perspective view of the present invention in the inverted position.
Figure 4:
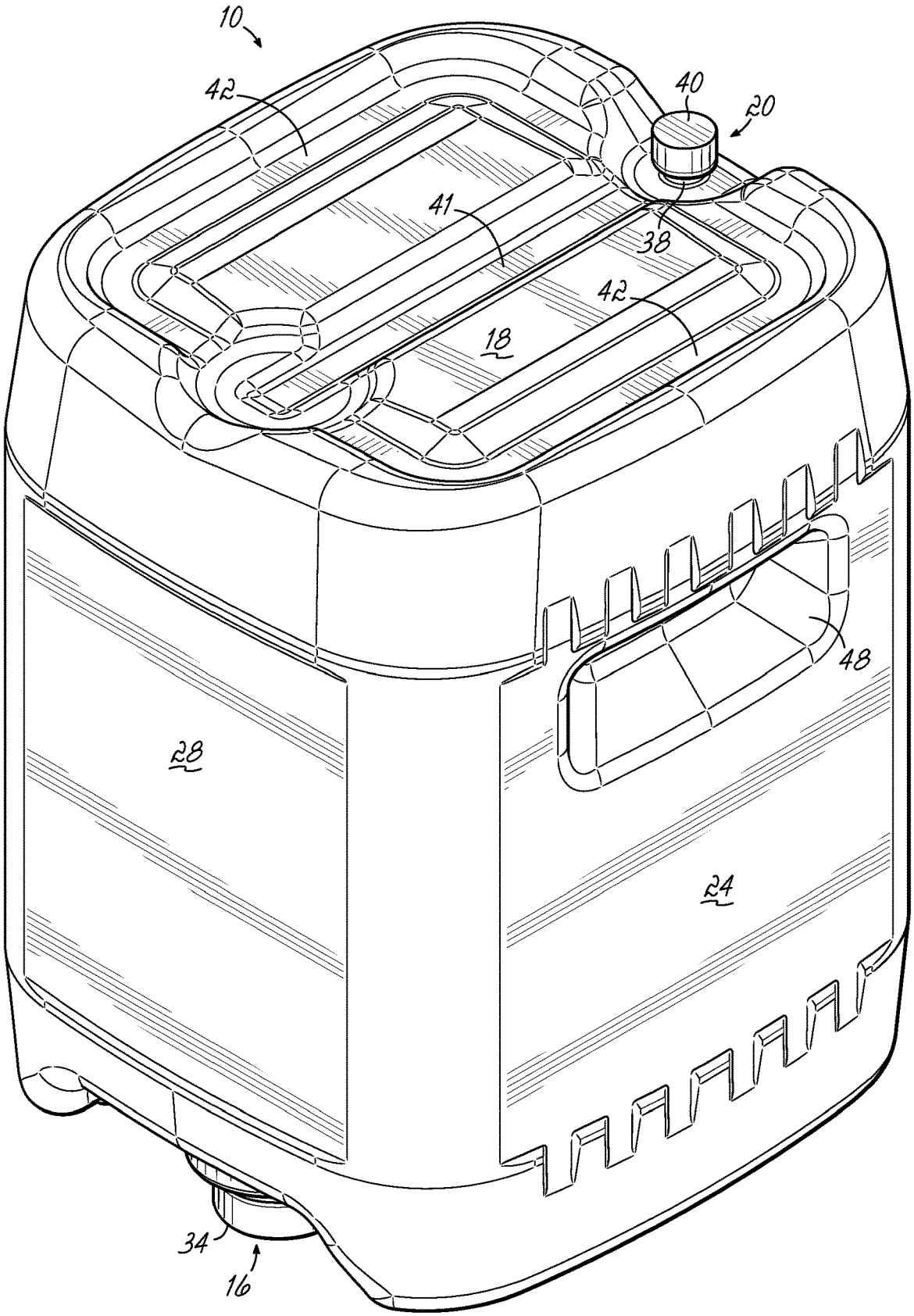
FIG. 4 is a perspective view similar to FIG. 3 showing the front of the container.
Figure 5:
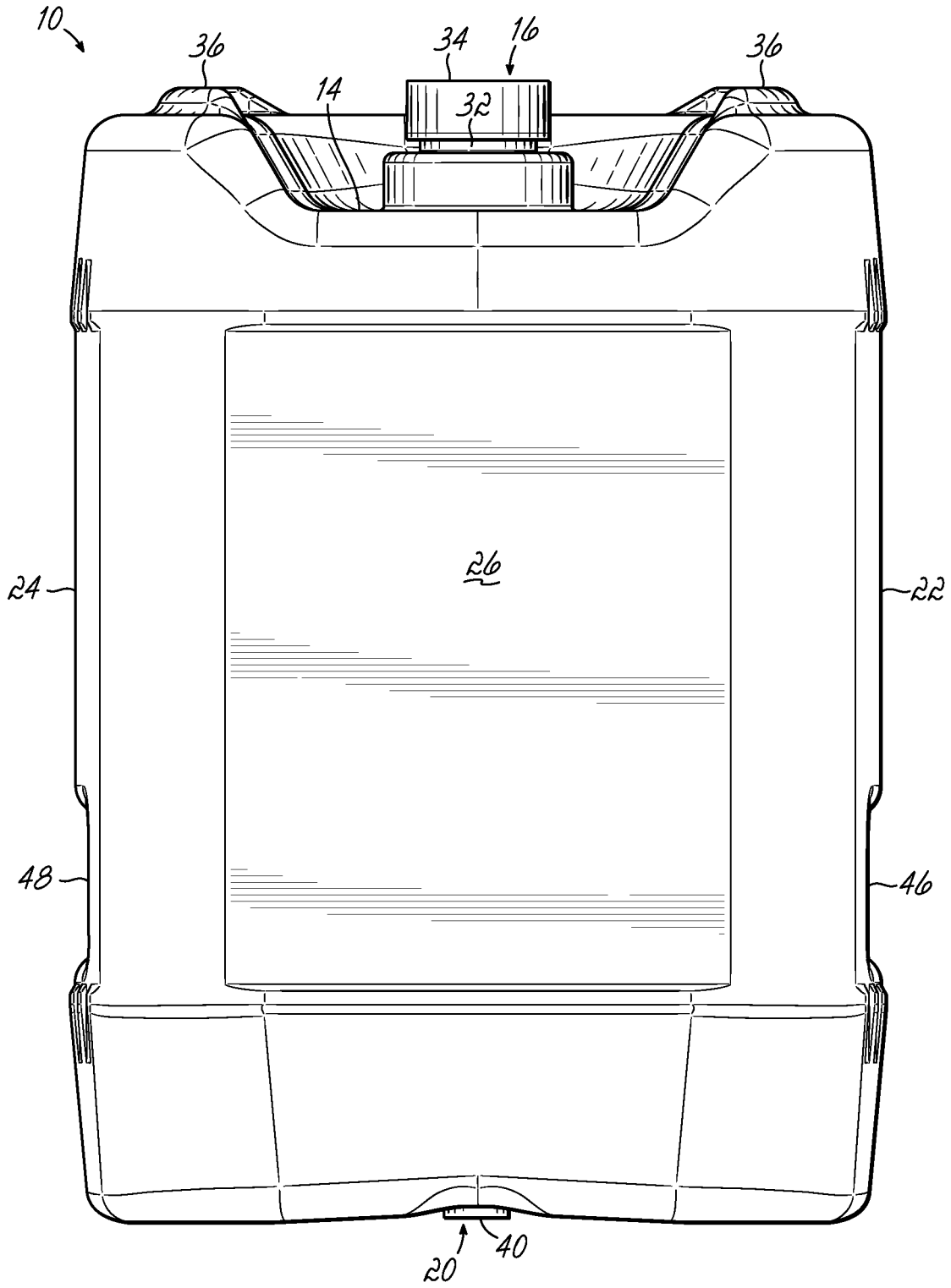
FIG. 5 is a front plan view of the present invention.
Figure 6:
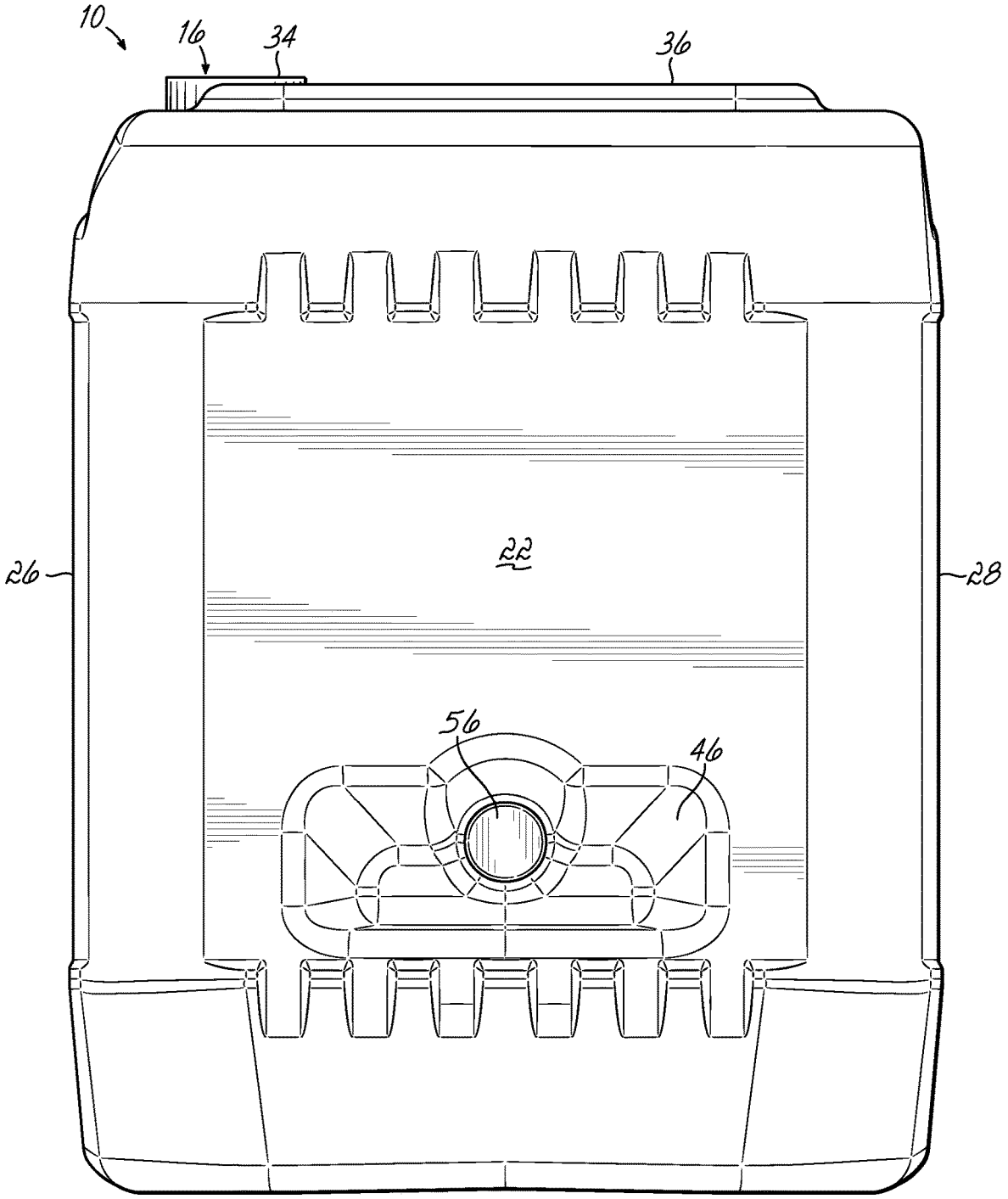
FIG. 6 is a side plan view of the present invention.
Figure 7:
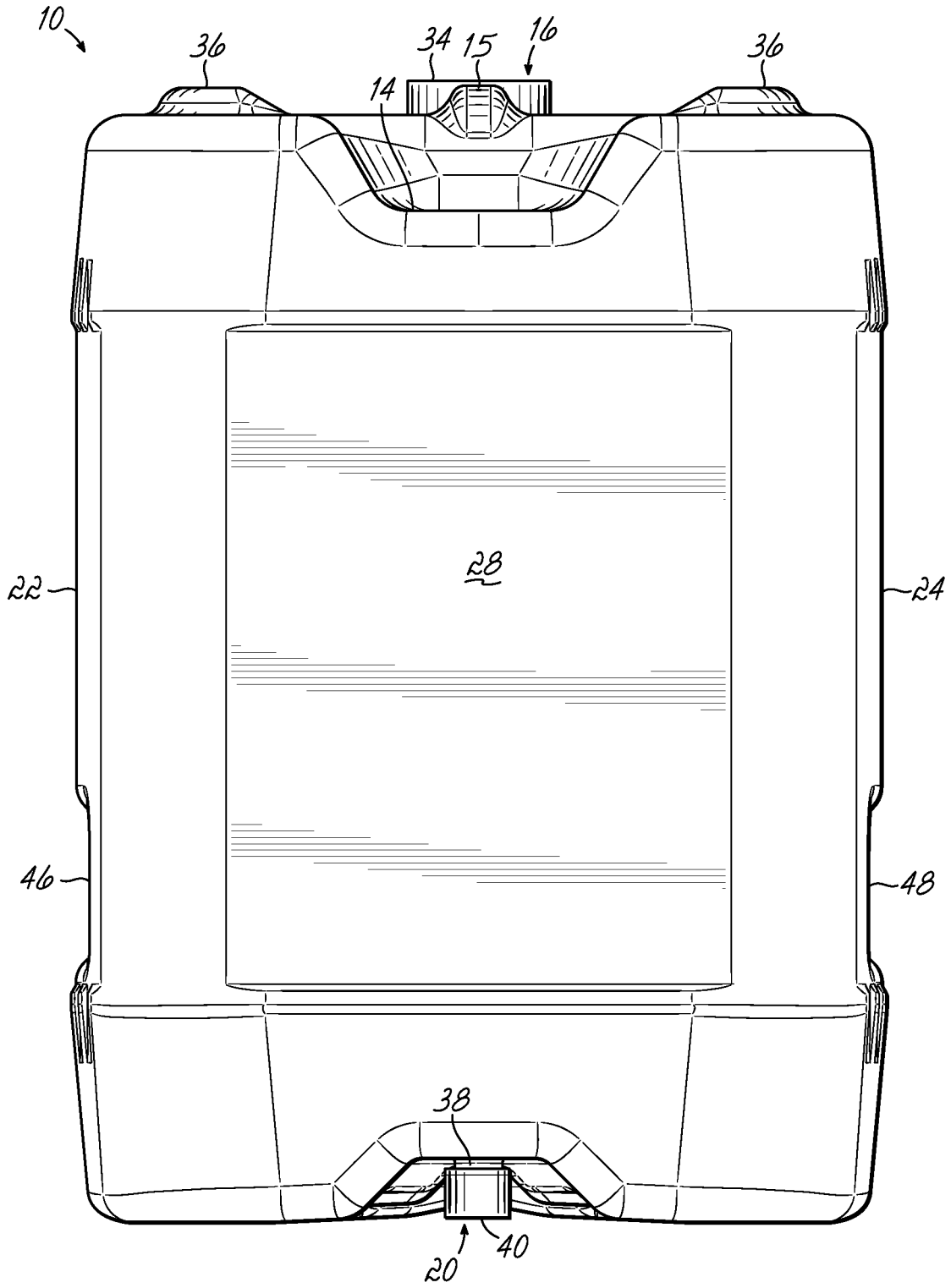
FIG. 7 is a rear plan view of the present invention.
Figure 8:
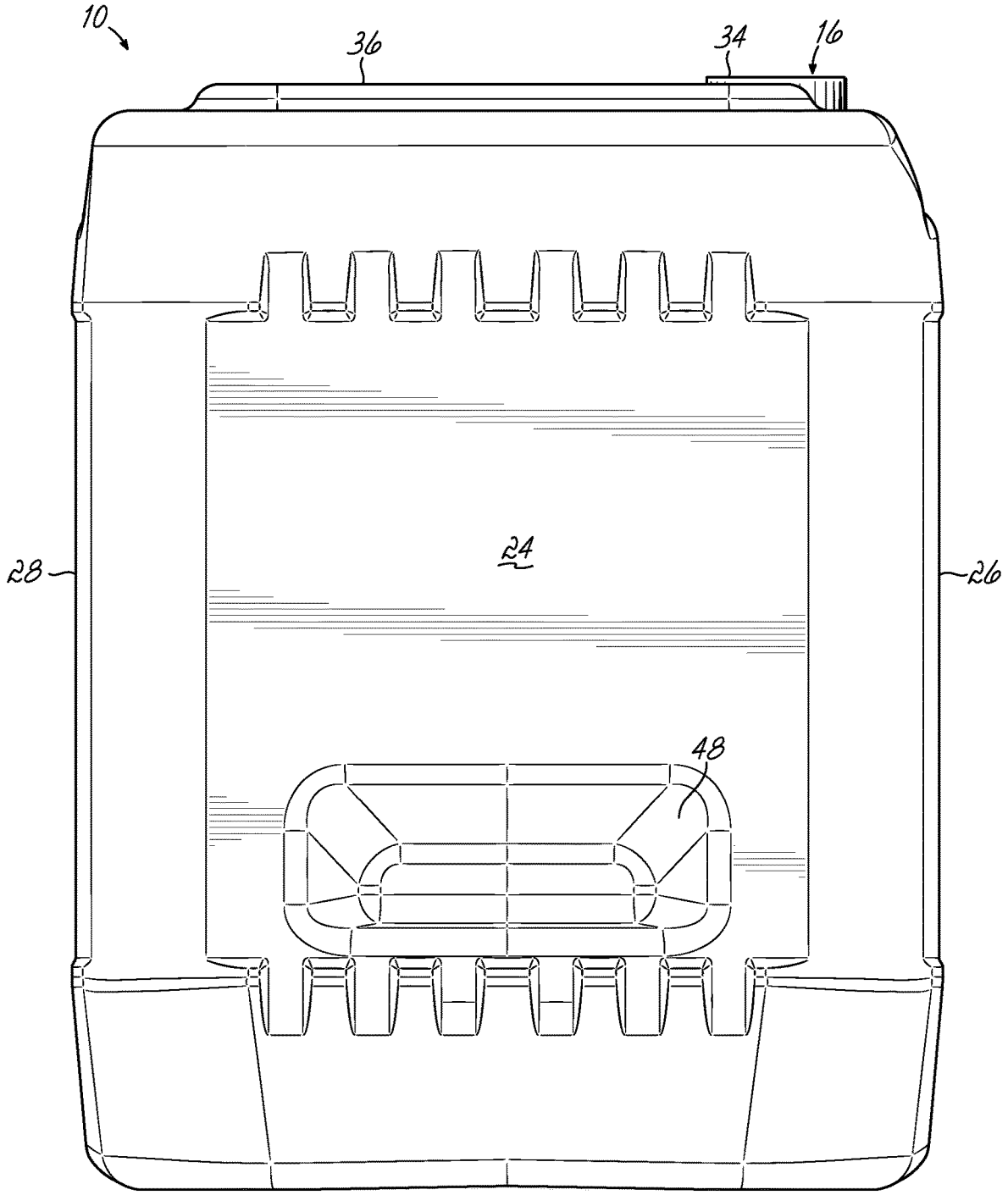
FIG. 8 is a second plan side view of the present invention.
Figure 9:
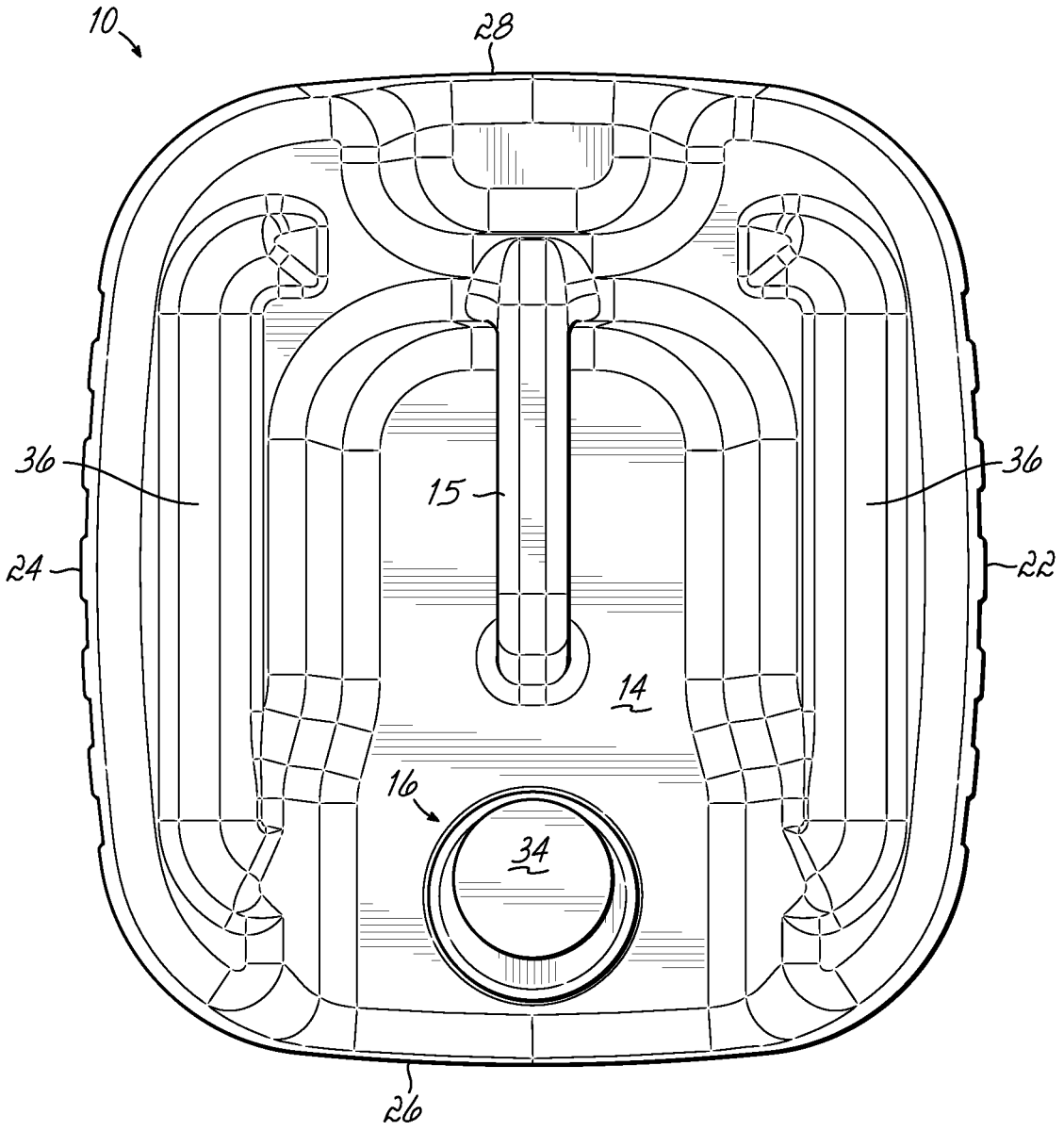
FIG. 9 is an overhead plan view of the present invention.
Figure 10:
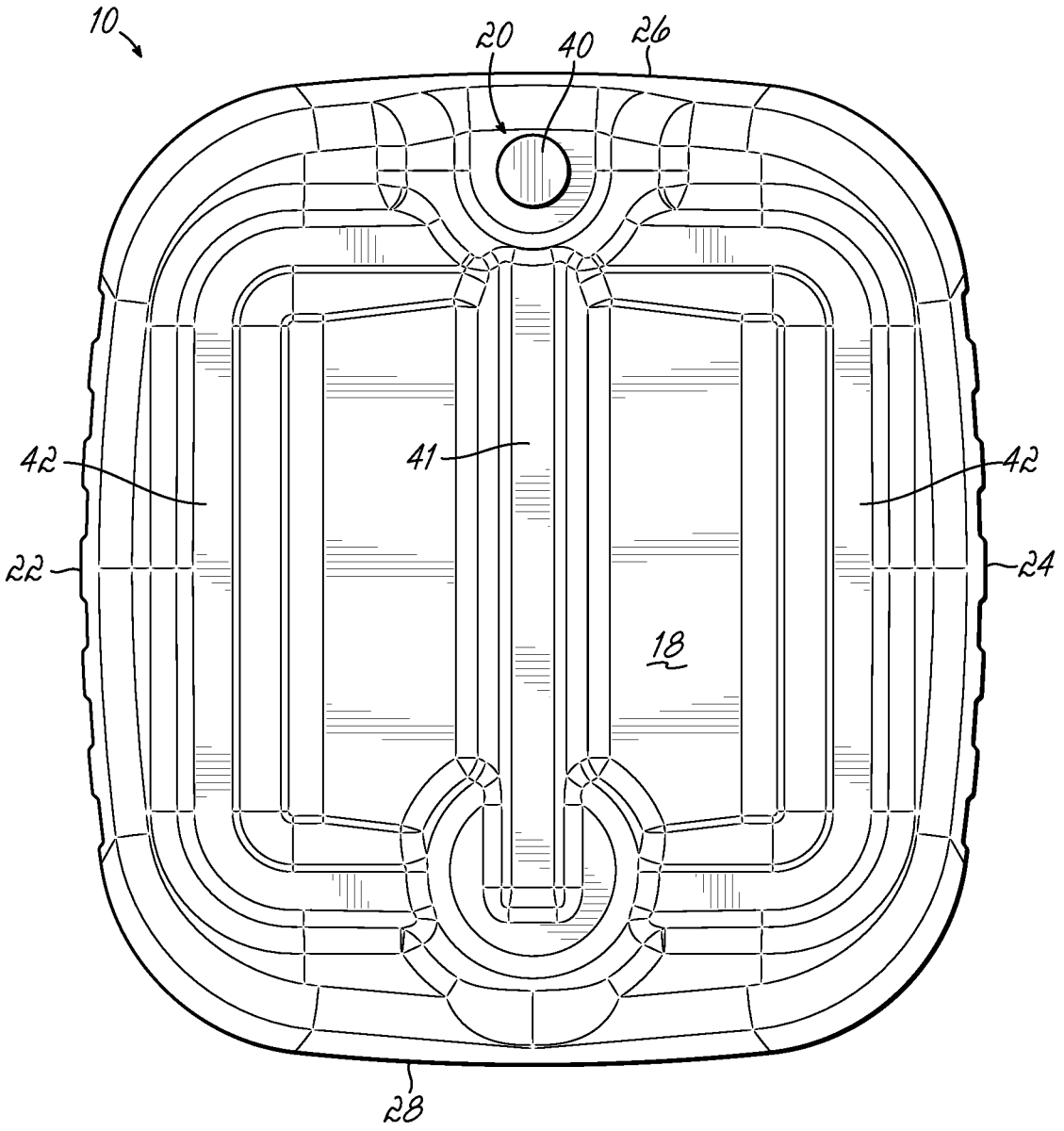
FIG. 10 is a bottom plan view of the present invention.

As shown in FIGS. 3 and 4, the vent port 20 through bottom surface 18 includes an externally threaded neck 38 and a cap 40. Further, the bottom surface 18 includes a peripheral recessed area 42 designed to receive the upper peripheral ridge 36 of top surface 14. Likewise, bottom surface 18 includes a central recessed portion 41 which is designed to receive the handle 15 when the bottom of the first container is stacked on the second container. Thus, the top surface 14 is nestable with the bottom surface 18.

The side walls 22 and 24 include handle recesses 46 and 48 which are designed to allow one to hold the container 10 with the top surface 14 in a downward orientation for positioning on a dispenser. These recesses 46 and 48 extend inwardly from side walls 22 and 24. These are indented far enough to allow for one to easily hold on to the container. Preferably they will be indented from about ¾ of an inch to 2 inches, more likely 1" to 1½" to allow one to easily grasp the containers 10 from the sides 22 and 24. These indentations 46 and 48 are generally parallel to the bottom surface 18, making it easier for the individual to hold. Further, hand recess 46 includes a further inner recess 56 which holds an adapter 54 which, as explained below, will allow the outlet port 16 to be connected to the dispenser 12.

Figure 12:
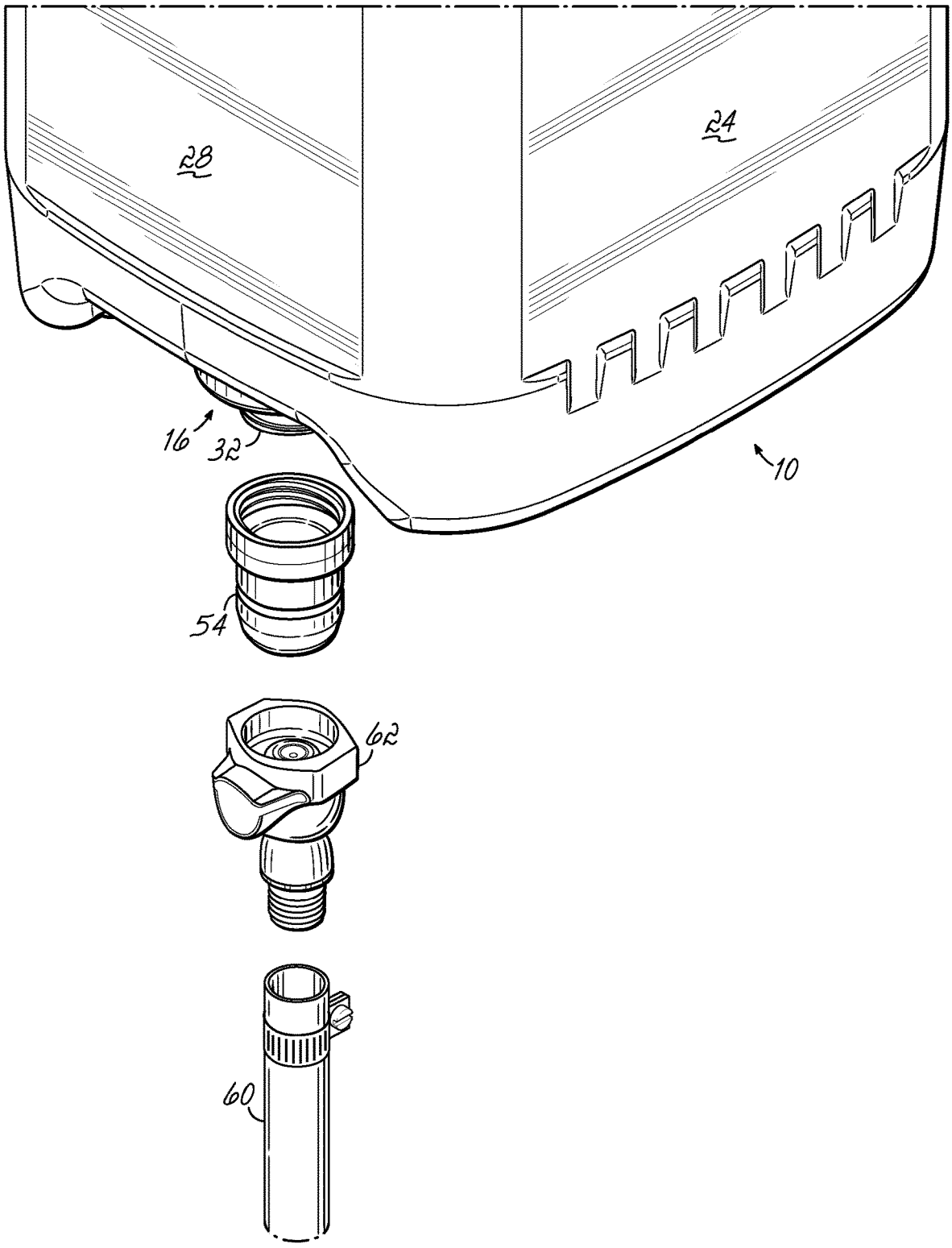
FIG. 12 is an exploded view showing portions of the container with the dispensing system.

In order to use the container 10 and the dispenser 12, the cap 34 is removed from outlet port 16 and the adapter 54 is pulled from recess 56 and is screwed onto the outlet port (see FIG. 12). In turn, a hose 60 leading to a pump (not shown) in dispenser 12 is attached to the adapter 54 via connector 62 and the container 10 is placed on a tray 58 on dispenser 12. The adapter 54 has a first side which mates with outlet port 16 and a second end that mates with connector 62. A second container is placed on tray 58 in the same manner, attached to a separate hose.

Once in place, the caps 40 over the vent ports 20 are removed, allowing air into the container as the adhesive flows into the hoses through gravity. Once the container 10 is emptied, new containers can be put in their place and the old ones either recycled or discarded.

In the event that the entire contents of the container 10 are not used at one time, the vent cap 40 can be placed back on the vent port 20 and the container 10 can be turned to an upright position and the cap 34 is screwed onto the outlet port 16 after the adapter 54 is removed. Thus, the material can be stored overnight and used the next day, if needed.

The containers act to prevent moisture from contaminating its moisture-sensitive contents. Further, the container will withstand extreme storage conditions. The design of the present invention allows for the continuous gravity-fed flow of the contents to a dispenser. Likewise, this design minimizes any moisture that would enter into the container. Finally, the handles and side wall make it easy for one to transport the container to place them in the inverted position on the tray of a dispenser.

This has been a description of the present invention, along with the preferred method of practicing the present invention. However, the invention itself should only be defined by the appended claims, wherein we claim:

What is claimed is:

1. A rigid plastic container having a top wall, bottom wall and side wall connecting said top wall to said bottom wall;
- said top wall having a dispensing port, said container configured to dispense contents therein through said dispensing port;
- said top wall having a handle;
- said top wall including a peripheral ridge configured to support said container in an inverted orientation on a surface;
- said bottom wall including a peripheral recessed area configured to receive a peripheral ridge of a complementary container when disposed in stacked relation;
- said bottom wall further including a central recessed portion configured to receive a handle of a complementary container when disposed in stacked relation;
- said bottom wall further including a venting port; said venting port recessed in said bottom wall;
- and said side wall having opposed first and second indentations adapted to allow an individual to hold said container with said top wall facing downwardly;
- said side wall further including a third indentation holding an adapter which mates with said dispensing port.

2. The container claimed in claim 1 wherein said first and second indentations are at least ¾ inches deep.

3. The container claimed in claim 2 wherein said first and second indentations are parallel to said bottom wall.

4. A dispensing system comprising a first container as claimed in claim 1, wherein said dispensing port is attached to a dispenser with said top wall resting on said dispenser, facing downwardly, said dispenser system including a pump adapted to pump dispensed contents of said container.

5. The dispensing system claimed in claim 4 wherein said system includes a second container as claimed in claim 1, wherein said second container is positioned on said dispenser with a dispensing port attached to said dispenser, said top wall resting on said dispenser facing downwardly.

6. The container claimed in claim 1 wherein said third indentation is contiguous with either said first or second indentation.

7. The container claimed in claim 1 wherein a thickness of said top wall, bottom wall, and side wall is from about 0.005 inch to about 0.090 inch.

8. The container claimed in claim 1 having a moisture vapor permeation rate of 0.015 US perms or less.

9. The container claimed in claim 1 wherein the plastic is selected from the group consisting of high density polyethylene, medium density polyethylene, polypropylene, poly (tetrafluoroethylene), and poly (vinylidene chloride).

10. The container claimed in claim 1 with a moisture vapor permeation rate suitable for storing components of a polyurethane adhesive.

* * * * *